US005244492A

United States Patent [19]

Cyr

[11] Patent Number: 5,244,492

[45] Date of Patent: Sep. 14, 1993

[54] PROCESS FOR RECOVERY OF METALLIC MERCURY FROM CONTAMINATED MERCURY-CONTAINING SOIL

[75] Inventor: Benoit Cyr, Quebec, Canada

[73] Assignee: PPG Industries, Inc., Pittsburgh, Pa.

[21] Appl. No.: 904,763

[22] Filed: Jun. 26, 1992

[51] Int. Cl.[5] ..... C22B 3/00

[52] U.S. Cl. ..... 75/742; 209/167; 405/128; 588/236

[58] Field of Search ..... 75/742; 588/236; 405/128; 209/167

[56] References Cited

U.S. PATENT DOCUMENTS

| | | | |
|---|---|---|---|
| 3,766,035 | 10/1973 | Ichiki et al. | 204/149 |
| 3,857,704 | 12/1974 | Coulter | 75/121 |
| 4,124,459 | 11/1978 | Blanch et al. | 204/99 |
| 4,186,087 | 1/1980 | Kato | 210/44 |
| 4,381,288 | 4/1983 | Weiss et al. | 423/101 |
| 4,424,081 | 1/1984 | Giguere | 134/10 |
| 4,522,723 | 6/1985 | Kauffman et al. | 210/611 |
| 4,783,263 | 11/1988 | Trost et al. | 210/638 |
| 4,844,873 | 7/1989 | Lebon et al. | 423/12 |

FOREIGN PATENT DOCUMENTS

| | | | |
|---|---|---|---|
| 3919788 | 7/1990 | Fed. Rep. of Germany | 405/128 |

OTHER PUBLICATIONS

Pollution Engineering, Jun. 15, 1992, p. 86, "Dutch Soil Washing in a Big Way".

*Primary Examiner*—Melvyn J. Andrews
*Attorney, Agent, or Firm*—Irwin M. Stein

[57] ABSTRACT

Describes a process for separating metallic mercury from soil containing same by producing an aqueous pulp of the contaminated soil in a mixing tank (12), screening the pulp in screening means (14) to separate a coarse fraction, further screening the pulp in screening means (17) (19) to produce a fines fraction, charging said fines fraction to solid-solid separating means (20) (24) to provide a first aqueous soil slurry (83) that is substantially free of metallic mercury and a second aqueous soil slurry (75) (81) containing metallic mercury, charging the second aqueous soil slurry to froth flotation cell means (28), thereby to provide a metallic mercury-containing froth (90) and an aqueous soil slurry (87) substantially free of metallic mercury, removing the froth from the flotation cell, and separating metallic mercury that settles out of the froth (95). Soil slurry substantially free of metallic mercury is flocculated (32), dewatered (35), filtered (36) and removed to a landfill (9).

18 Claims, 1 Drawing Sheet

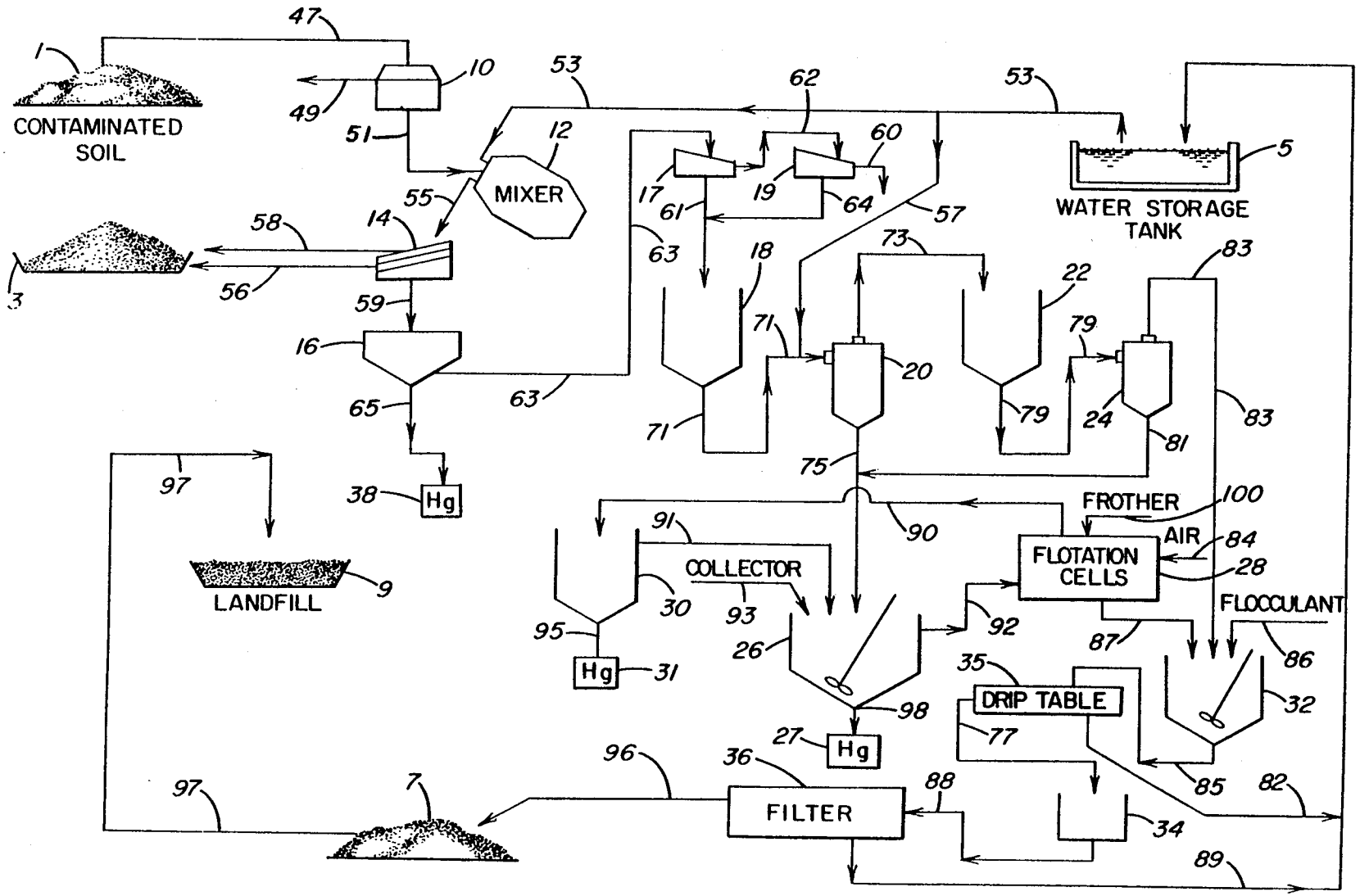
WATER STORAGE TANK
FLOCCULANT
FROTHER
AIR
FLOTATION CELLS
DRIP TABLE
COLLECTOR
FILTER
MIXER
Hg
LANDFILL
CONTAMINATED SOIL

PROCESS FOR RECOVERY OF METALLIC MERCURY FROM CONTAMINATED MERCURY-CONTAINING SOIL

DESCRIPTION OF THE INVENTION

The present invention relates to a method for separating metallic mercury from mercury-containing solid materials, such as soils and other non-hazardous, particulate, water-insoluble materials. More particularly, the invention is directed to a process involving sequential steps for the removal and recovery of visible metallic mercury from contaminated soil, and to the preparation of the resulting treated soil product for isolated storage.

Mercury cathode alkali-chlorine electrolysis cells represent a significant industrial use of metallic mercury. In that electrolytic process, mercury that is solubilized in the depleted salt brine removed from the electrolysis cells is recovered and returned to the cells. Soil in the proximity of such cells has been found to contain small amounts of metallic mercury.

In order to comply with various governmental regulations, industrial sites, such as alkali-chlorine electrolysis plants that use mercury cathodes, the proximate soil of which contains metallic mercury must be reconditioned before the site may be utilized for purposes other than the original industrial one. Even in the case of a currently operating mercury cathode alkali-chlorine industrial plant, it is advantageous for ecological reasons to remove mercury from the soil at the plant site.

Various methods have been proposed for separating mercury from waste water and mercury brine sludge. Among those that can be mentioned are Ichiki et al, U.S. Pat. No. 3,766,035, Coulter, U.S. Pat. No. 3,857,704, Weiss et al, U.S. Pat. No. 4,381,288, and Blanch et al, U.S. Pat. No. 4,124,459.

Trost et al, U.S. Pat. No. 4,783,263, describes removing toxic organic substances from soils, rocks, clays, sediments, sludges and aqueous streams by (i) collecting the contaminated material, (ii) converting it to a slurry, adding one or more surfactants and/or alkaline agents to the slurry to free the toxic organic substance and place it in the liquid phase of the slurry, (iii) concentrating the toxic organic substance in a flotation cell, and (iv) collecting the toxic organic substance for disposal.

At many industrial sites, the soil that contains metallic mercury is made up of a variety of other constituent materials including rocks, sand, clay, inorganic and organic materials, and other waste or debris. Because of the volume of soil that commonly must be treated to decontaminate a metallic mercury-contaminated site, the nature and character of metallic mercury and the need to minimize the amount of treated soil to be stored in a landfill, the cost of removing metallic mercury from soil can be high. In accordance with the present invention, a multi-step economical decontamination process has been developed to achieve the separation and recovery of substantially all visible metallic mercury present in mercury-contaminated soil, thereby providing a solution to an industry problem. By visible metallic mercury is meant mercury that can be seen by the naked eye during inspection of the soil.

The present invention relates to a multi-step process for decontaminating soil that contains visible metallic mercury, which includes the sequential steps of: producing a first aqueous slurry of mercury-contaminated soil fines; charging the aqueous slurry of mercury-contaminated soil to solid-solid separator means, thereby to provide a second aqueous soil slurry that is substantially-free of visible metallic mercury and a third aqueous soil slurry that contains visible metallic mercury; charging visible metallic mercury-contaminated aqueous soil slurry resulting from the previous step to froth flotation cell means, thereby to provide a metallic mercury-containing froth and an aqueous soil slurry substantially free of visible metallic mercury; removing metallic mercury-containing froth from the flotation cell; and separating metallic mercury from the metallic mercury-containing froth. The soil slurry removed from the flotation cell may be dewatered, the dewatered soil dried and then forwarded to an appropriate storage area. By the foregoing process, visible metallic mercury is separated from soil containing same and the soil which previously contained such metallic mercury stored in a security landfill.

BRIEF DESCRIPTION OF THE DRAWING

The sole FIGURE is a diagrammatic representation of an embodiment of the sequential multi-step process of the present invention.

DETAILED DESCRIPTION OF THE INVENTION

The following description of the present invention is made with reference to the accompanying drawing. The process begins with collecting the soil that is visibly contaminated with metallic mercury, e.g., by excavation, and storing such soil at a designated location on site. Reference numeral 1 refers generally to the store of soil visibly contaminated with metallic mercury. This soil is commonly comprised of a multitude of solid components including: large foreign objects, such as debris, metal, tree limbs, tree roots and rocks, as well as conventional soil components; namely, gravel, sand, salt and clay. Common soil components may be classified according to size (diameter) by ASTM Method D-422, as shown by the following tabulation wherein "D" represents the approximate diameter of the component.

| COMPONENT | DIAMETER "D" (mm) |
|---|---|
| Pebbles, Rocks | $D > 76.2$ |
| Gravel | $4.75 < D < 76.2$ |
| Sand | |
| Heavy | $2.000 < D < 4.750$ |
| Medium | $0.425 < D < 2.000$ |
| Fine | $0.075 < D < 0.425$ |
| Silt | $0.005 < D < 0.750$ |
| Clay | $D < 0.005$ |

The first stage of the process of the invention involves: transforming the mercury-contaminated soil into a pulp or slurry and treating the pulp to separate the large soil components, e.g., by a screening operation, thereby preparing the pulp for the primary mercury separation stage. Preliminary to the first stage, it may be necessary to subject the contaminated soil to a preliminary gross screening operation for removal of the aforementioned large foreign objects, such as debris, metals, tree limbs, roots, etc.

As shown in the drawing, contaminated soil from store 1 is forwarded, as shown by reference line 47, to a hopper 10, which is equipped with a grill (not shown) to separate large foreign objects from the soil. Such transfer may be accomplished by any convenient means such as by conveyor means, e.g., a belt conveyor, or by a front end loader. The grill may be sized conveniently to remove foreign objects six inches (15.2 centimeters) in diameter or larger. Foreign objects retained on the grill (usually about 1.5 weight percent of the charge to hopper 10) are removed, as shown by reference line 49. Such oversized objects may be washed with high pressure water to remove any adhering metallic mercury and then forwarded to landfill 9 (if the oversized objects are debris) or returned to store 1 (if the oversized objects are soil).

Contaminated soil passing through the grill of hopper 10 is forwarded, as shown by reference line 51, to mixer 12 where it is mixed with water delivered from process water storage tank 5 by means of transfer line 53. Process water may be that which is available from a municipal water system, or may be recycled process water. In mixer 12, which may take the form of a rotary mixing machine such as generally utilized in the preparation of cement, the structure of the soil is broken down into small particles by the agitation, attrition and mixing that occurs in mixer 12. The breakdown of the soil into small particles frees metallic mercury from the soil and suspends the soil particles in water, thereby forming a soil pulp or slurry.

Mixer 12 is equipped with mixing means that provides sufficient mechanical agitation to the soil charged thereto so as to break-up lumps of soil, e.g., clay, into small suspendable particles, thereby allowing formation of a soil pulp and the freeing of metallic mercury adhering to or encased within such soil lumps. The amount of time required to prepare the pulp in mixing vessel 12 will depend on the water content of the soil. Generally, about 10–45 minutes, e.g., about 20–30 minutes, of agitation of the soil and water is sufficient to produce a pulp which is then forwarded to screening means 14, as shown by reference line 55.

The amount of water required to prepare the soil pulp in mixer 12 is that amount needed to prepare a readily flowable aqueous slurry of mercury-contaminated soil, e.g., an amount necessary to prepare a slurry having a solids content of between about 15 and 30 weight percent. The amount of water charged to mixer 12 to prepare the soil slurry will be conditioned on the amount of water already present in the soil, e.g., by natural means, such as rainfall. The solids content of the slurry is that amount of solids dispersed in the slurry, as distinguished from large aggregates of soil or pebbles or other large components of the soil, i.e., those passing through the grill in hopper 10, that are not dispersed by the agitating means in mixer 12 and fall to the bottom of the mixer. The suspended soil will generally have a diameter of about 0.25 inch (0.64 centimeter) or smaller.

It has been found beneficial, vis-a-vis, the effectiveness in preparing the pulp, to wet down the soil before charging it to the mixer. This may be accomplished by charging the soil and the water to mixer 12 simultaneously. Further, to assist in forming the pulp, the mixer may contain a portion of the water to be charged before any soil is added. The rate at which the remaining water is added to the mixer is calculated to be such that the water charge is completed when the soil charge is finished. By using the aforedescribed techniques, the effectiveness of slurry preparation, i.e., the percent of the dispersible soil charged that is dispersed, is generally greater than 95%.

Screening means 14 to which the pulp from mixer 12 is charged may comprise any suitable classification means that separates the undispersed heavy material in the slurry, e.g., pebbles, gravel and large sand particles, allows washing of such heavy material to remove any adhering metallic mercury, does not prevent the passage of mercury droplets, and provides a fine fraction suitable for treatment by solid-solid separation means, e.g., cyclones, for separation of the metallic mercury. Screening means 14 may comprise vibrating particle separation devices. As shown, screening means 14 comprises an arrangement of screens to allow the particles in the slurry (dispersed and non-dispersed) to be successfully classified. For example, screening means 14 may comprise at least two screens of decreasing size, e.g., a first or top screen having about a 1.5 inch (3.8 centimeters) diameter opening, and a second screen having about a 0.25 inch (0.64 centimeters) diameter opening. Alternatively, screening means 14 may comprise a series of individual screens having successively smaller openings. Screening means 14 removes about 10 to 20 weight percent of the soil contents charged to mixer 12.

Coarse material retained on the first or top screen is washed with water to remove any film of soil pulp adhering to this coarse fraction that may contain metallic mercury, and is then forwarded to collection site 3 as shown by reference line 58. Solids retained on the lower, e.g., second, screen are forwarded to collection site 3, as shown by reference line 56. This fraction may also be washed, as described with respect to the coarse fraction. Material forwarded to collection site 3 is comprised principally of pebbles, gravel and other coarse aggregate material which passed through the grill in hopper 10. The washed, coarse fractions forwarded to collection site 3 may be forwarded periodically to landfill 9. If the coarse fractions forwarded to collection site 3 contains large aggregates (lumps) of soil or clay that have not been broken down in mixer 12 into a soil pulp, such lumps of soil are recycled to mixer 12 and not forwarded to landfill 9. The fines, i.e., material passing through the second or lower screen (the fine fraction) is forwarded to receiving tank 16, as shown by reference line 59.

The accompanying FIGURE does not illustrate washing of both fractions from screening means 14. Such washing, which is contemplated to be a high pressure water wash, is commonly performed on the screen, thereby adding to the water content of the slurry in receiving tank 16. Alternatively, such washing may be performed on separate screens. The water from such a separate washing step may be recycled to the process, e.g., to mixer 12 or receiving tank 16. Droplets of metallic mercury in receiving tank 16, which are heavier than the dispersed soil, fall to the bottom of the tank from where they are removed periodically and stored in mercury flask 38, as shown by reference line 65.

The foregoing described steps comprise the initial stage of the process, and these steps are generally performed batchwise, although it is contemplated that such steps may be performed in a continuous manner by the use of continuous conveying means feeding multiple mixer means 12, which feed multiple screening means 14.

The pulp in tank 16 is forwarded to a further screen, e.g., vibrating screen 17, which has smaller openings than the bottom screen of screening means 14, e.g., one (1) millimeter diameter openings, as shown by reference line 63, for the purpose of producing a fraction suitable for solid-solid separator means 20. The coarse fraction retained on screen 17 is forwarded to another screen, e.g., vibrating screen 19, as indicated by reference line 62, which screen also has small, e.g., one (1) millimeter, diameter openings. The coarse fraction regained on screen 19 is removed from the screen, as shown by reference line 60, and forwarded to collection site 3. The fine materials which pass through screens 17 and 19 are forwarded to cyclone feed tank 18, as indicated by reference lines 61 and 64.

As shown in the accompanying Figure, the next stage of the process, which is the secondary separation stage, comprises an arrangement of hydroclones (cyclones) in series which are used to separate additional metallic mercury from the slurry of soil present in cyclone feed tank 18. As shown, this soil slurry is forwarded from feed tank 18 to primary cyclone stage 20, as shown by reference line 71. The percent solids of the aqueous soil pulp removed from tank 18 is adjusted, if needed, e.g., by the addition of further water to transfer line 71, as shown by reference line 57, to produce a pulp having a solids content of between about 10 and 20 weight percent.

The primary (rougher) cyclone stage (as shown by cyclone 20) and the secondary (scavenger) cyclone stage (as shown by cyclone 24) may each be a single cyclone or a group of cyclones. The discharge from the overflow from the primary cyclone stage 20, which comprises the finer particles and a major portion of water, is forwarded, as shown by reference line 73, to secondary cyclone feed tank 22. Slurry from secondary cyclone feed tank 22 is forwarded to secondary cyclone stage 24, as shown by reference line 79. The discharge from the underflow of the primary and secondary cyclone stages, which comprises the majority of the particles with the greater density and a small amount of water is forwarded to flotation cell feed tank 26, as shown by reference lines 75 and 81. Finely-divided soil slurry discharged from the overflow of the secondary cyclone stage 24 is substantially free of metallic mercury and is forwarded to flocculator 32, as shown by reference line 83.

The cyclones may be operated with the underflow open to the atmosphere or closed to the atmosphere, i.e., discharging the more dense particles into a closed trap from whence these solids are removed. The use of cyclones for the secondary separation stage allows the concentration of mercury charged to this stage. For example, when using hydroclones open to the atmosphere, concentrates of from 2300 ppm mercury to 4200 ppm mercury have been obtained from soil slurries containing 1000 ppm mercury. The use of cyclones with a trap have allowed concentrates of from 10,000 to 20,000 ppm of mercury to be obtained from soil slurries containing 1200 to 1300 ppm of mercury.

In accordance with the process of the present invention, concentrated mercury-containing soil solids from the secondary separation stage is treated in a third separation stage to further concentrate the mercury and separate it from the soil. As shown in the drawing, mercury-containing soil solids in flotation cell feed tank 26 is mixed with chemical collectors, as shown by reference line 93. The collector is a chemical reagent which attaches to the surface of metallic mercury particles to render those particles air-avid (aerophilic) and water repellent (hydrophobic). Any suitable collector known in the art that attaches itself to particulate mercury may be used.

Suitable chemical collectors include the $C_2$–$C_6$ xanthates such as Aero® 350 Xanthate, a potassium amyl xanthate, and sodium sulfhydrate (NaSH). These collectors, which may be used alone or in combination, are typically used in amounts of between about 1.1 pounds (0.5 kilograms) and about 2.2 pounds (1.0 kilograms) per ton (907 kilograms) of solids (on a dry basis) treated in the flotation cell. Other xanthates that are contemplated are the sodium and potassium metal salts of ethyl xanthate, isobutyl xanthate, n-amyl xanthate and isopropyl xanthate. Any chemical collector that renders the mercury particles aerophilic and water repellent (hydrophobic) may be used. Such collectors are used in aerophilic rendering air avid amounts. Any metallic mercury that collects at the bottom of flotation cell feed tank 26 may be removed and forwarded to mercury flask 27, as shown by reference line 98.

In addition to the chemical collectors, frothing or dispersing agents are also added to the flotation cells, as shown by reference line 100, to maintain the integrity of the air bubbles formed in the cell and to allow skimming of the resulting froth at the top of the flotation cell. Any of the conventional frothing or dispersing agents known in the art may be used in conventional amounts known by the skilled artisan to obtain the aforementioned result. A usual dosage used is reported to be 0.01–0.2 pounds/ton (5–100 grams/metric ton) of solids. Some frothing agents contemplated include polypropylene glycol, such as Aerofroth® 65 Frother, Cresylic acid and pin oil.

Mercury-containing soil solids in the flotation cell feed tank 26 are forwarded to flotation cells 28, as shown by reference line 92. Flotation cells 28 may comprise a plurality of flotation cells in series. In common practice, the plurality of cells are known as roughers, cleaners and scavenger cells. Flotation cells 28 are provided at the lower portion thereof with a gas dispersing unit designed to form bubbles. As shown, air is introduced into cells 28 by reference line 84 to form air bubbles. Any gas that does not chemically disturb the operation of the flotation cell and which is not absorbed in the water may be used. Examples of gases that are contemplated are air, nitrogen, inert gas and mixtures of such gases. Air is economically preferred. With vigorous agitation and aeration, the mercury particles attach themselves to the air bubbles and rise to the surface of the cell to form a layer of froth at the top of the flotation sell.

Froth is skimmed from the top of the cell and forwarded to mercury concentration vessel 30, as shown by reference line 90. Metallic mercury is separated from the froth in concentration tank 30, and removed therefrom and forwarded to flask 31, as shown by reference line 95. The remaining components of the froth, e.g., water, are removed from the mercury concentration tank 30, as shown by reference line 91, and recycled to the flotation cell feed tank 26 when appropriate. The flotation cell operation allows the removal and concentration of a substantial portion of the mercury charged to the flotation cell.

In accordance with an embodiment of the present invention, the soil slurry discharged from the overflow of the second stage of the hydroclones and the soil slurry that is discharged from flotation cells 28 are forwarded to flocculator 32, as shown by reference lines 83 and 87. Because the clay fraction of soil may be difficult to physically separate from water by filtration of the slurry, flocculant is added to flocculator 32, as shown by reference line 86, in order to flocculate (agglomerate) the soil, e.g., clay, to the degree that allows it to be separated from the water component of the slurry by means of conventional solid-liquid separating means 36, e.g., a plate and frame filter.

As shown in the accompanying FIGURE, an aqueous slurry of flocculated soil is forwarded to dewatering means, e.g., drip table 35, to partially dewater the soil, as shown by reference line 85. The aqueous slurry of flocculated soil typically has a solids content of from about 15 to 20 weight percent. Dewatered flocculated soil, which typically has a solids content of about 30 to 35 weight percent, is discharged from the drip table 35 and is forwarded to filter feed tank 34, as shown by reference line 77, from whence it is forwarded periodically, as shown by reference line 88, to filter means 36 wherein a further portion of the water component of the dewatered flocculated soil is separated from the soil. Filter means 36 will typically produce a filter cake containing from about 60 to 65 weight percent solids. Thus, the combination of the drip table and filter means concentrates the slurry of flocculated soil from about 15–20 weight percent solids to 60 to 65 weight percent. Water separated from the flocculated soil by drip table 35 may be treated to separate small particles of flocculatant that pass through the filter cloth or leak past the seals at the edge of the filter cloth of the drip table. The treated water is returned to the process water storage tank 5, as shown by reference line 82. Recovered flocculant may be recyclied to flocculator 32, e.g., by returning it to the discharge line of the feed pump (not shown) feeding flocculator 32.

Any suitable flocculant may be used in appropriate flocculating amounts to agglomerate the soil and its clay fraction into particles of a size that may be recovered readily by solid-liquid separatory means, e.g., filter means, such as plate and frame filter means, expression filters, vacuum filters and belt filter presses. Flocculants contemplated herein include copolymers of acrylamide, polyacrylamide and anionic, cationic or non-ionic flocculants, such as products sold under the PERCOL trademark by Allied Colloids. The amount of flocculant used may vary from 0.05 to 0.15 weight percent, based on the weigh of soil in the slurry. Typically, flocculant is added until hyperflocculation is observed, e.g., when large quick separation flocs form and a clear supernatant remain.

Water removed from filter 36 may be treated to separate small particles of flocculant that pass through the filter cloth before being recycled to the process water storage tank 5, as shown by reference line 89. The filter cake is forwarded to collection site 7, as shown by reference line 96, wherein the soil may be further dehydrated by allowing it to dry at ambient temperatures. Eventually the recovered soil is forwarded from collection site 7 to secure landfill 9, as shown by reference line 97.

The present invention is illustrated in more detail in the following Example, which is intended as illustrative only since numerous modifications and variations therein will be apparent to those skilled in the art.

EXAMPLE

Soil containing visible metallic mercury was passed through a grate designed to remove debris and rocks larger than 6 inches (15.2 centimeters) in diameter. Oversized debris and rocks, which represented about 2 weight percent of the contaminated soil charged to the grate was visually inspected for visible metallic mercury. If visible mercury was observed, the contaminated oversized debris and rocks were manually washed with a high pressure water jet spray. Visibly uncontaminated debris and rocks (including those manually washed) were forwarded to a secure landfill.

Soil passing through the grate (about 8400 pounds, 3810 kg) was charged to a conventional cement mixer and mixed with 2100 gallons (7949 liters) of water for from 20 to 30 minutes. The soil slurry from the mixer tank was discharged over a first pair of vibrating screens, the upper screen having a mesh size opening of 1.5 inches (3.8 centimeters) and the lower screen having a mesh size opening of 0.25 inches (0.64 centimeters). Slurry passing through the lower screen was forwarded to a first tank wherein metallic mercury droplets in the slurry were allowed to settle. The mercury that collected at the bottom of this tank was drawn off periodically to a mercury storage flask.

Rejected rocks and debris from the first pair of vibrating screens were, when appropriate, washed with high pressure water to dislodge any visible metallic mercury, and then forwarded to a secure landfill. Rejected rocks and debris comprised about 20 weight percent of the charge to the first pair of screens. Soil slurry from the first tank was forwarded to a second series of vibrating screens, each having a mesh opening of one (1) millimeter. Slurry passing through the second series of vibrating screens was collected in a second tank. The solids content of the slurry in the second tank was about 18 to 20 weight percent. Material rejected from the second series of screens, which comprised about 5 weight percent of the charge to the second series of screens, was handled in the same manner as the rejected material from the first pair of screens.

Soil slurry from the second tank (after having the solids content thereof adjusted to about 15 weight percent by the addition of water) was pumped to a two-stage hydrocycloning zone. Each stage of the hydrocycloning zone was comprised of three hydrocyclones operating in parallel. The hydrocyclones were operated so as to separate low density (clay) particles from the higher density (sand and mercury) particles. Low density material discharged as overflow from the hydrocyclones of the first stage served as the feed to the hydrocyclones in the second stage. Overflow slurry from the hydrocyclones of the second stage was forwarded to a flocculator feed tank and then pumped to the flocculator tank for treatment with flocculant.

The underflow from both stages of the hydrocycloning zone was forwarded to a flotation cell feed tank from where it overflowed to flotation cells. Aero ® 350 Xanthate chelating agent, a potassium amyl xanthate, was added to the flotation cell feed as a 10 weight percent aqueous solution at a rate of 0.006 gallons/minute (0.023 liters/minute). In addition, a frothing agent (AEROFROTH ® 65 Frother) was added to the flotation cells as a 10 weight percent aqueous solution at a rate of 0.002 gallons/minute (0.008 liters/minute).

The froth produced in the flotation cell was pumped forward to a collection vessel wherein the mercury settled out and was drawn off periodically to a mercury flask. The overflow from the collection vessel was recycled to the flotation cell feed tank. Slurry from the bottom of the flotation cell was withdrawn and mixed in the flocculator feed tank with the overflow discharge from the second stage hydroclones.

Flocculating agent (Percol ® 725 flocculant) was added to the overflow slurry at the discharge of the flocculator feed pump at a rate of 0.1 weight percent, based on the weight of soil in the slurry. Solids in the flocculator were permitted to agglomerate. The discharge from the flocculator was forwarded to a drip table equipped with a moving cloth. The overflow discharge from the drip table was a slurry of 30–35 weight percent solids, which was forwarded to a filter feed tank, and when a sufficient amount of slurry had accumulated, charged to a plate filter press. The filter cake from the press (about 60–65 weight percent solids) was forwarded to a secure landfill.

Approximately 1.5 kilograms of metallic mercury was recovered in the mercury flasks from about 35 tons (31,751 kilograms) of mercury-containing soil treated (based on the dry weight of the soil).

I claim:

1. A method for separating metallic mercury from metallic mercury-contaminated soil comprising the steps of:

(a) providing an aqueous slurry of said contaminated soil, (b) charging said aqueous slurry of contaminated soil to solid-solid separator means, thereby to provide a first aqueous soil slurry that is substantially-free of visible metallic mercury and a second aqueous soil slurry that contains metallic mercury, (c) charging second aqueous soil slurry resulting from step (b) to froth flotation cell means, thereby to provide a metallic mercury-containing froth and an aqueous soil slurry substantially free of visible metallic mercury, (d) removing metallic mercury-containing froth from the flotation cell, and (e) separating metallic mercury from the metallic mercury-containing froth.

2. The method of claim 1 wherein the aqueous soil slurry substantially free of visible metallic mercury from step (c) is treated with flocculant in amounts sufficient to cause hyperflocculation of the soil within the slurry.

3. The method of claim 1 wherein the solids content of the aqueous slurry of contaminated soil charged to the solid-solid separator means of step (b) is from about 10 to 20 weight percent.

4. The method of claim 3 wherein hydroclones are used as solid-solid separator means.

5. The method of claim 1 wherein chemical collector is added to the froth flotation cell means of step (c) in aerophilic rendering air avid amounts.

6. The method of claim 5 wherein the chemical collector is selected from the group consisting of sodium or potassium salt of a $C_2$–$C_6$ xanthate and sodium sulfhydrate.

7. The method of claim 6 wherein the chemical collector is potassium amyl xanthate.

8. The method of claim 6 wherein the chemical collector is added in an amount of from about 1.1 to 2.2 pounds of chemical collector per ton of solids.

9. The method of claim 5 wherein frothing agent is added to the froth flotation cell means in an amount sufficient to maintain the integrity of the froth produced in step (c).

10. The method of claim 9 wherein the frothing agent is selected from the group consisting of polypropylene glycol, cresylic acid and pine oil.

11. The method of claim 4 wherein the particles of soil of the aqueous slurry charged to said solid-solid separator means are less than 1 millimeter in diameter.

12. A method for separating visible metallic mercury from metallic mercury-contaminated soil comprising the steps of:

(a) producing a first aqueous readily flowable slurry of mercury-contaminated soil, (b) charging first aqueous slurry having a solids content of from 10 to 20 weight percent to hydroclones, thereby to provide a second aqueous soil slurry that is substantially-free of visible metallic mercury and a third aqueous soil slurry containing visible metallic mercury, (c) charging third aqueous soil slurry to froth flotation cell means, thereby to provide a metallic mercury-containing froth and a fourth aqueous soil slurry substantially-free of visible metallic mercury, (d) removing metallic mercury-containing froth from the flotation cell, and (e) separating metallic mercury from the metallic mercury-containing froth.

13. The method of claim 12 wherein chemical collector selected from the group consisting of sodium or potassium salt of $C_2$–$C_6$ xanthate and sodium sulfhydrate is added to froth flotation cells means in amounts of from 1.1 to 2.2 pounds per ton of solids.

14. The method of claim 13 wherein frothing agent selected from the group consisting of propylene glycol, cresylic acid and pine oil is also added to the froth flotation cell means.

15. The method of claim 12 wherein second aqueous soil slurry and fourth aqueous soil slurry are combined, combined slurry is treated with flocculant in an amount sufficient to cause hyperflocculation of the soil particles in the combined slurry, and flocculated slurry is charged to liquid-solid separating means to separate water from the flocculated soil particles.

16. The method of claim 1 wherein aqueous soil slurry substantially free of visible metallic mercury from step (c) is charged to liquid-solid separating means to separate water from the soil.

17. The method of claim 12 wherein second aqueous soil slurry and fourth aqueous soil slurry are combined, and combined slurry is charged to liquid-solid separating means to separate water from the soil particles.

18. The method of claim 17 wherein separated water is used to produce the first aqueous slurry of mercury-contaminated soil.

* * * * *